US011302492B2

(12) United States Patent
Mattioli

(10) Patent No.: US 11,302,492 B2
(45) Date of Patent: Apr. 12, 2022

(54) INTEGRATED ELECTROMECHANICAL DEVICE

(71) Applicant: HIKE S.R.L., Milan (IT)

(72) Inventor: Riccardo Alberto Mattioli, Bologna (IT)

(73) Assignee: HIKE S.R.L., Milan (IT)

( * ) Notice: Subject to any disclaimer, the term of this patent is extended or adjusted under 35 U.S.C. 154(b) by 120 days.

(21) Appl. No.: 16/956,744

(22) PCT Filed: Dec. 21, 2018

(86) PCT No.: PCT/IB2018/060486
§ 371 (c)(1),
(2) Date: Jun. 22, 2020

(87) PCT Pub. No.: WO2019/123401
PCT Pub. Date: Jun. 27, 2019

(65) Prior Publication Data

US 2020/0321168 A1 Oct. 8, 2020

(30) Foreign Application Priority Data

Dec. 22, 2017 (IT) ..... 102017000149087

(51) Int. Cl.
*H01H 1/58* (2006.01)
*H01H 50/14* (2006.01)
(Continued)

(52) U.S. Cl.
CPC ..... *H01H 1/2025* (2013.01); *H01H 1/58* (2013.01); *H01H 9/02* (2013.01); *H01H 50/14* (2013.01)

(58) Field of Classification Search
USPC ..... 307/132 R
See application file for complete search history.

(56) References Cited

U.S. PATENT DOCUMENTS 3,811,102 A 5/1974 Ash
6,573,814 B1 * 6/2003 Ichikawa ..... H01H 50/443 335/128

FOREIGN PATENT DOCUMENTS

EP 0531890 A1 3/1993
EP 1065689 A2 1/2001
(Continued)

OTHER PUBLICATIONS

International Search Report and Written Opinion for corresponding PCT/IB2018/060486, dated Apr. 9, 2019, 10 pages.

*Primary Examiner* — Rexford N Barnie
*Assistant Examiner* — Xuan Ly
(74) *Attorney, Agent, or Firm* — Armstrong Teasdale LLP

(57) ABSTRACT

An integrated electromechanical device is described, including a support body, a first and a second fixed contact, a first, second, third, and fourth variable position contact, a first and a second control circuit, and a first, second, third, and fourth signal conductive terminal. A first control conductive terminal is connected to the first control circuit, and a second control conductive terminal is connected to the second control circuit. The first, second, third, and fourth variable position contacts and the first and second fixed contacts are arranged such that, in any positioning configuration of the first and second and third and fourth variable position contacts, the first and second fixed contacts are in a condition of electrical isolation therebetween. Connection end regions of the first and second control conductive terminal are on a first connection plane, and connection end regions of each signal conductive terminal are on a second connection plane.

15 Claims, 6 Drawing Sheets

(51) Int. Cl.
*H01H 1/20* (2006.01)
*H01H 9/02* (2006.01)

(56) References Cited

FOREIGN PATENT DOCUMENTS

| | | | |
|---|---|---|---|
| FR | 2146197 | A1 | 3/1973 |
| WO | 2013186799 | A1 | 12/2013 |

* cited by examiner

INTEGRATED ELECTROMECHANICAL DEVICE

CROSS-REFERENCE TO RELATED APPLICATIONS

This application is a National Phase filing of PCT International Application No. PCT/IB2018/060486, having an International Filing Date of Dec. 21, 2018, which claims the benefit of priority to Italian Patent Application No. 102017000149087, having a filing date of Dec. 22, 2017, each of which is hereby incorporated by reference in its entirety.

TECHNICAL SECTOR

The present invention relates to an electromechanical device, particularly for highly integrated electrical apparatuses. In particular, the invention concerns an integrated electromechanical device with opposing dual-mounting having a given inner structure.

PRIOR ART

Recent developments in electronics have made it possible to reduce the overall size of consumer and industrial electronic products. In particular, the reduction in the size of products is a natural consequence of a continuously improving design of the internal components, which very often have been redesigned on the basis of new technologies.

The current electromechanical devices are produced with the concept of being assembled on a circuit board; this, unlike the present invention, involves a production of larger circuit boards and, in the case of multiple, overlapping circuit boards, requires the use of connectors that make electrical connections between at least two circuit boards with an additional increase in space and costs.

SUMMARY OF THE INVENTION

One object of the present invention is to propose an integrated electromechanical device that may be used in all products that have multiple circuit boards, or a single circuit board shaped in such a way as to create an overlapping of two areas, within which the electromechanical device may be interposed.

Such structure allows further integration of the products by reducing, for example, the areas of the circuit boards that make up such products, for example by eliminating the internal connectors for connecting between the various electronic boards and consequently also the mounting areas thereof.

The aforementioned and other objects and advantages are achieved, according to an aspect of the invention, via an integrated electromechanical device having the features defined in claim 1. Preferred embodiments of the invention are defined in the dependent claims, which are intended as an integral part of the present description.

In summary, the present invention concerns an integrated electromechanical device that comprises a support body including a plurality of sides.

The integrated electromechanical device comprises moreover a first fixed contact and a second fixed contact, a first variable position contact, a second variable position contact, a third variable position contact, a fourth variable position contact, a first control circuit arranged to control the first variable position contact and the third variable position contact, and a second control circuit arranged to control the second variable position contact and the fourth variable position contact, and a plurality of signal conductive terminals.

The plurality of signal conductive terminals comprising a first signal conductive terminal connected to the first variable position contact, a second signal conductive terminal connected to the second variable position contact, a third signal conductive terminal connected to the third variable position contact and a fourth signal conductive terminal connected to the fourth variable position contact.

At least one first control conductive terminal is connected to the first control circuit and at least one second control conductive terminal is connected to the second control circuit.

The first signal conductive terminal in a first predetermined condition is electrically connected to the second fixed contact and in a second predetermined condition is connected to the first fixed contact by means of said first variable position contact. The first control circuit controls the transition from the first condition to the second condition and vice versa.

The third signal conductive terminal in a first predetermined condition is electrically connected to the first fixed contact and in a second predetermined condition is connected to the second fixed contact by means of said third variable position contact. The first control circuit controls the transition from the first condition to the second condition and vice versa.

The second control conductive terminal and the second fixed contact, in a predetermined conduction condition, are electrically connected to each other via said second variable position contact and, in a predetermined isolation condition, are not electrically connected to each other. The second control circuit controls the transition from the conduction condition to the isolation condition and vice versa.

The fourth conductive terminal and the first fixed contact, in a predetermined conduction condition, are electrically connected to each other via said fourth variable position contact and, in a predetermined isolation condition, are not electrically connected to each other. The second control circuit controls the transition from the conduction condition to the isolation condition and vice versa.

The first variable position contact, the second variable position contact, the third variable position contact, the fourth variable position contact, the first fixed contact and the second fixed contact are made so that, in any positioning configuration of the first variable position contact, of the second variable position contact, of the third variable position contact and of the fourth variable position contact, the first fixed contact and the second fixed contact are always in an electrical isolation condition therebetween; The at least one first control conductive terminal, the at least one second control conductive terminal and each signal conductive terminal of said plurality of signal conductive terminals each comprise a respective connection end region distal with respect to the support body.

The connection end regions of the at least one first control conductive terminal and of the at least one second control conductive terminal are disposed on a first connection plane and the connection end regions of each signal conductive terminal of said plurality of signal conductive terminals are disposed on a second connection plane.

The second connection plane is different and parallel to said first connection plane.

BRIEF DESCRIPTION OF THE DRAWINGS

Further features and advantages of the invention will become apparent from the detailed description that follows, provided purely by way of non-limiting example with reference to the accompanying drawings, wherein.

DETAILED DESCRIPTION

Figure 1:
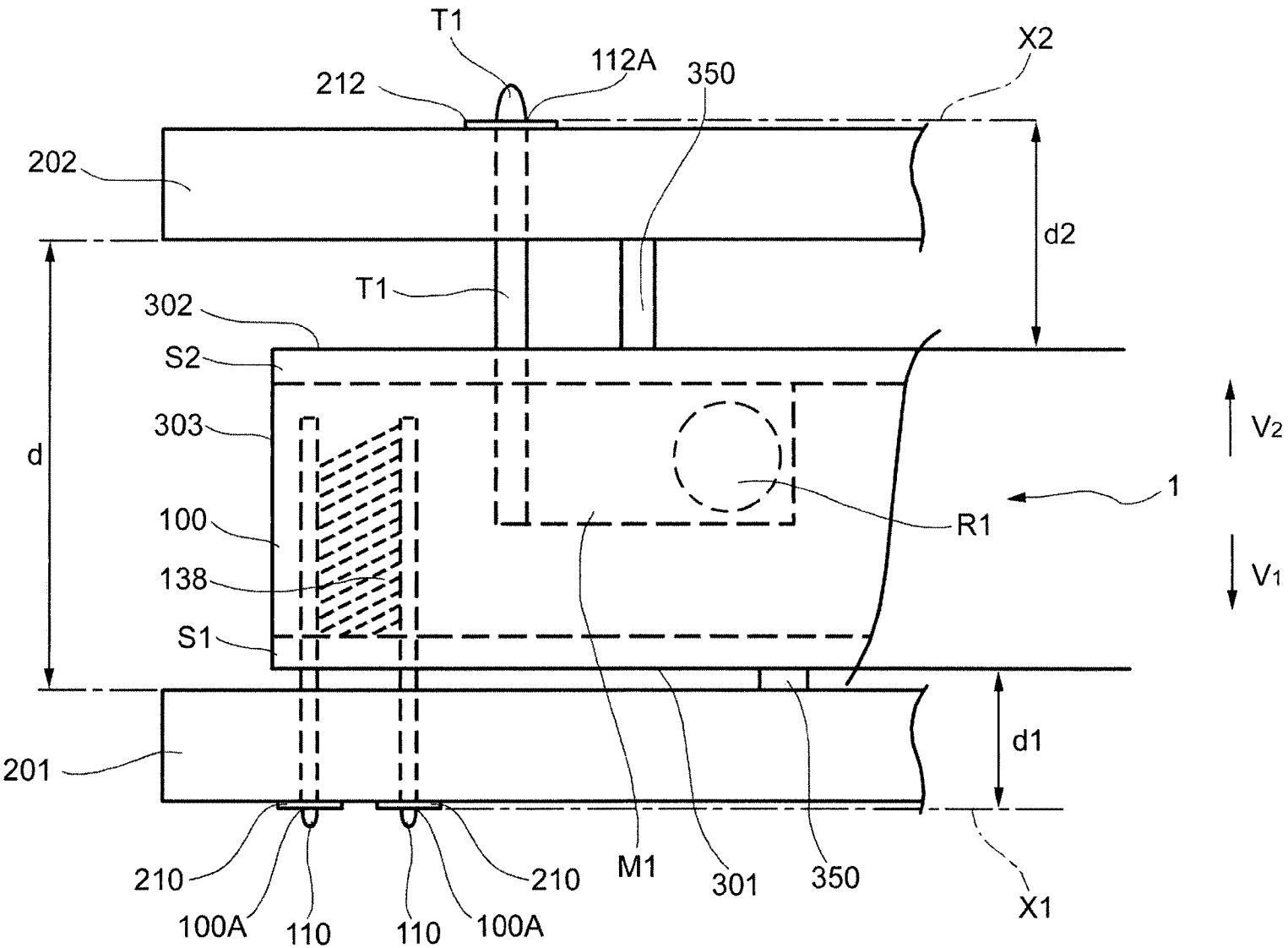
FIG. 1 illustrates a side view of a first variable position contact M1 and a control circuit 138, which allow for opposing mounting of two circuit boards.

Before explaining a plurality of embodiments of the invention in detail, it should be clarified that the invention is not limited in its application to the details of construction and to the configuration of the components presented in the following description or illustrated in the drawings. The invention may assume other embodiments and may be implemented or achieved in essentially different ways. It should also be understood that the phraseology and terminology have descriptive purposes and should not be construed as limiting. The use of "include" and "comprise" and the variations thereof are to be understood as encompassing the elements stated hereinafter and the equivalents thereof, as well as additional elements and the equivalents thereof.

In a first embodiment, the integrated electromechanical device 1 comprises a support body 100 including a plurality of sides 301, . . . , 306.

The integrated electromechanical device 1 further comprises a first fixed contact 158 and a second fixed contact 158', a first variable position contact M1, a second variable position contact M2, a third variable position contact M3, a fourth variable position contact M4, a first control circuit 138 and a second control circuit 138'.

The first control circuit 138 is arranged to control the first variable position contact M1 and the third variable position contact M3.

The second control circuit 138' is on the other hand arranged to control the second variable position contact M2 and the fourth variable position contact M4.

The integrated electromechanical device 1 further comprises a plurality of signal conductive terminals T1, T2, T3, T4. In the present document, the expression "signal" means a power supply signal and/or a signal that conveys information.

The plurality of signal conductive terminals T1, T2, T3, T4 comprise a first signal conductive terminal T1 connected to the first variable position contact M1, a second signal conductive terminal T2 connected to the second variable position contact M2, a third signal conductive terminal T3 connected to the third variable position contact M3 and a fourth signal conductive terminal T4 connected to the fourth variable position contact M4.

At least one first control conductive terminal 110 is connected to the first control circuit 138 and at least one second control conductive terminal 110' is connected to the second control circuit 138'.

The first signal conductive terminal T1, in a first predetermined condition, is electrically connected to the second fixed contact 158' and, in a second predetermined condition, is connected to the first fixed contact 158 by means of said first variable position contact M1.

The first control circuit 138 controls the transition from the first condition to the second condition and vice versa.

The third signal conductive terminal T3 in a first predetermined condition is electrically connected to the first fixed contact 158 and in a second predetermined condition is connected to the second fixed contact 158' by means of said third variable position contact M3. The first control circuit 138 controls the transition from the first condition to the second condition and vice versa.

The second signal conductive terminal T2 and the second fixed contact 158', in a predetermined conduction condition, are electrically connected to each other via said second variable position contact M2 and, in a predetermined isolation condition, are not electrically connected to each other. The second control circuit 138' controls the transition from the conduction condition to the isolation condition and vice versa.

The fourth conductive terminal T4 and the first fixed contact 158, in a predetermined conduction condition, are electrically connected to each other via said fourth variable position contact M4 and, in a predetermined isolation condition, are not electrically connected to each other. The second control circuit 138' controls the transition from the conduction condition to the isolation condition and vice versa.

The first variable position contact M1, the second variable position contact M2, the third variable position contact M3, the fourth variable position contact M4, the first fixed contact 158 and the second fixed contact 158' are made so that, in any positioning configuration of the first variable position contact M1, the second variable position contact M2, the third variable position contact M3 and the fourth variable position contact M4, the first fixed contact 158 and the second fixed contact 158' are always in an electrical isolation condition therebetween.

The at least one first control conductive terminal 110, the at least one second control conductive terminal 110' and each signal conductive terminal of said plurality of signal conductive terminals T1, T2, T3, T4, each comprise a respective connection end region 100A, 112A distal with respect to the support body 100.

The connection end regions 100A of the at least one first control conductive terminal 110 and the at least one second control conductive terminal 110' are disposed on a first connection plane x1. The connection end regions 112A of each signal conductive terminal of said plurality of signal conductive terminals T1, T2, T3, T4 are on the other hand disposed on a second connection plane x2.

The second connection plane x2 is different and parallel to said first connection plane x1.

Figure 4:
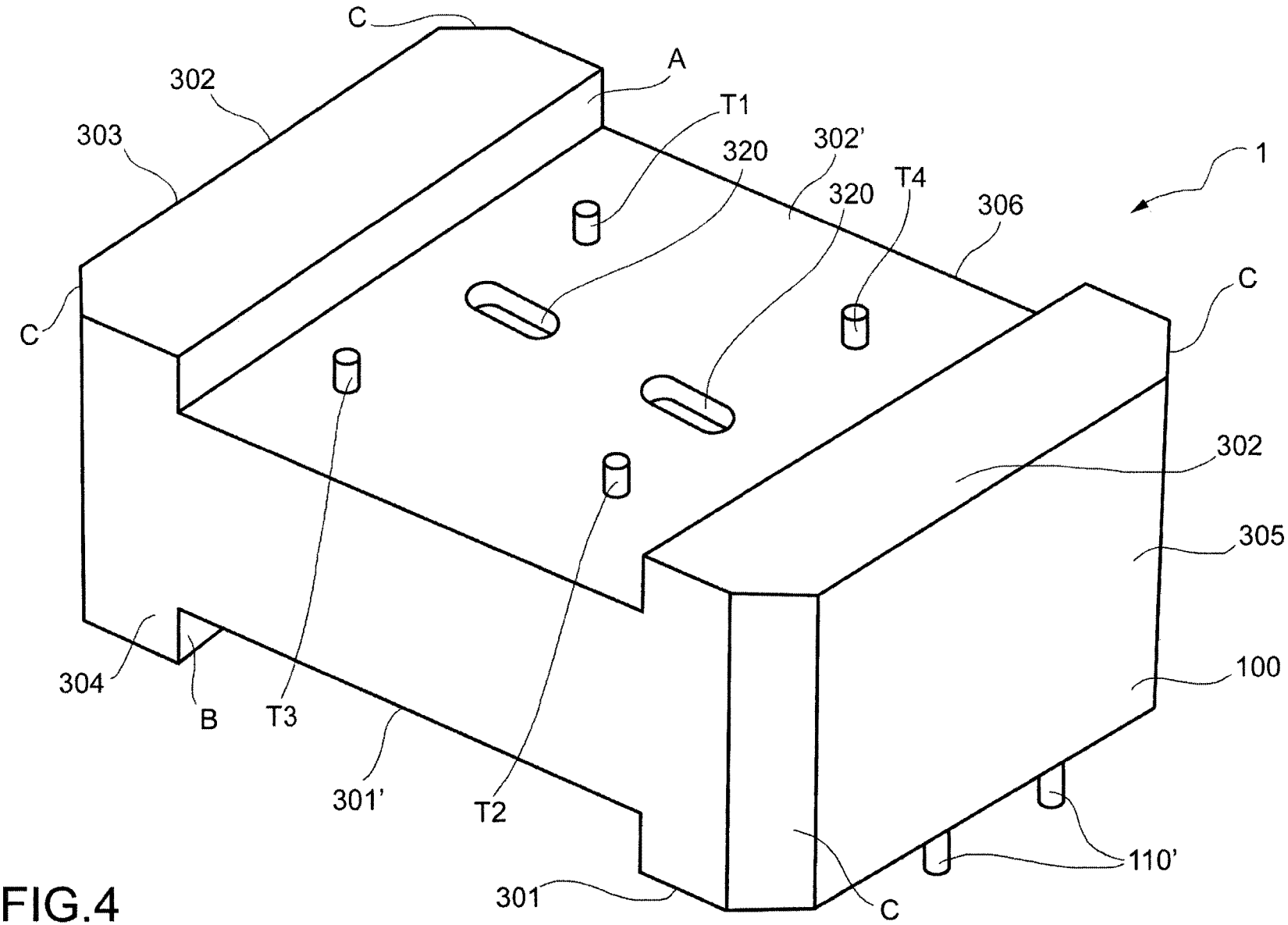
FIG. 4 is a perspective view by way of example of an electromechanical device integrated according to the invention.

As shown in detail in FIG. 4, the support body 100 may have such a shape whereby the plurality of signal conductive terminals T1, T2, T3, T4 may be disposed on, or exiting from, a surface 302 or another surface 302' which is parallel to the surface 302, at a distance A.

Moreover, the support body 100 may be of such a shape whereby the at least one first control conductive terminal 110 and/or the at least one second control conductive terminal 110' may be disposed on, or exiting from, a surface 301 or another surface 301', parallel to the surface 301, at a distance B.

The first control circuit 138 may comprise at least one first control sub-circuit 138A arranged to control the first variable position contact M1 and a second control sub-circuit 138B arranged to control the third variable position contact M3.

The first variable position contact M1 may be controlled independently of the third variable position contact M3.

Figure 3:
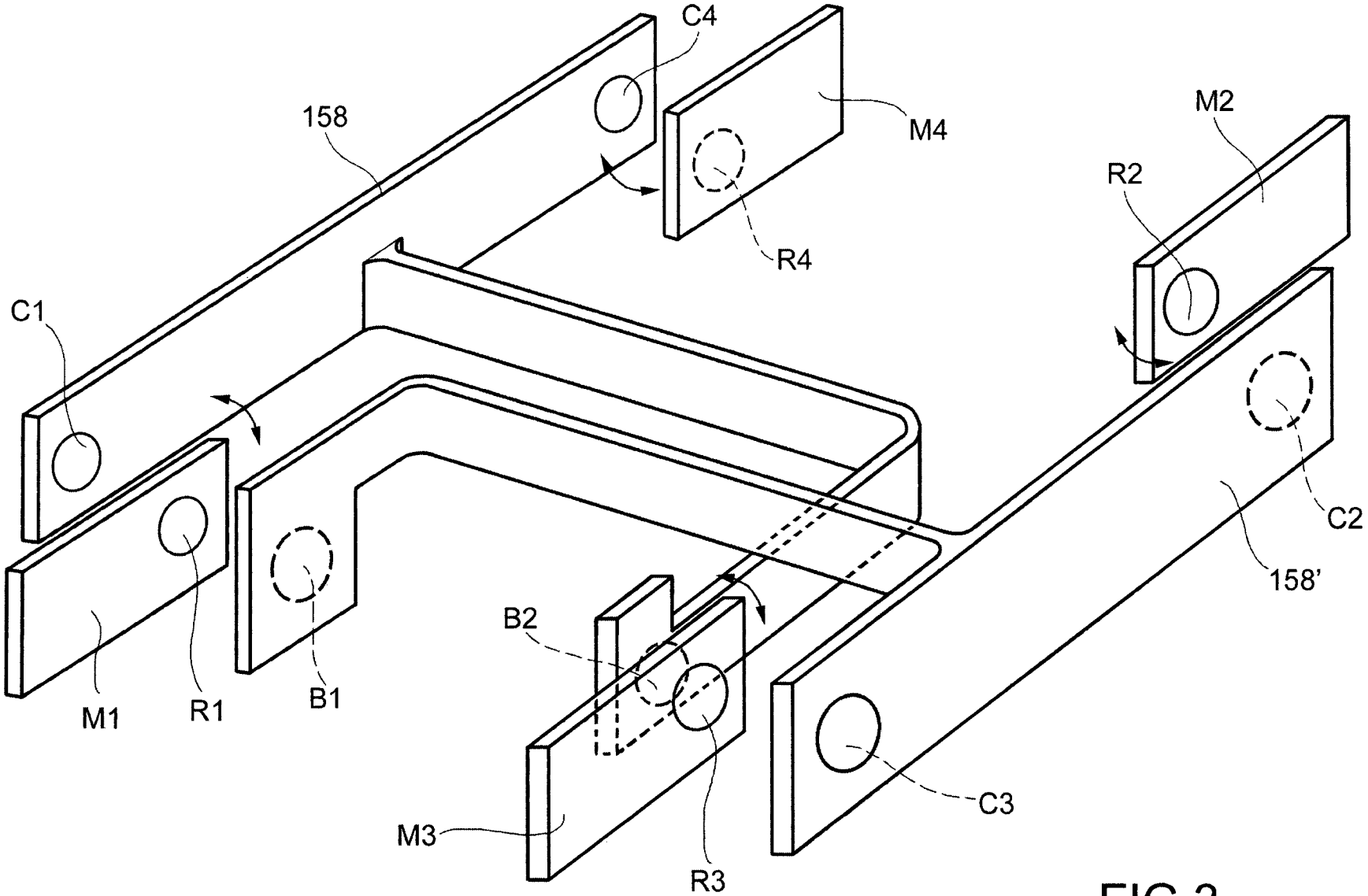
FIG. 3 illustrates a detailed view of the variable position contacts and fixed contacts of the integrated electromechanical device shown in FIG. 2 or FIG. 3.

As may be observed in FIG. 3, the second control circuit 138' may comprise at least one first control sub-circuit 138A arranged to control the second variable position contact M2 and a second control sub-circuit 138B arranged to control the fourth variable position contact M4.

The second variable position contact M2 may be controlled independently of the fourth variable position contact M4.

The presence of the two control sub-circuits 138A and 138B, which separately control the variable position contacts M2 and M4, make it possible to make two totally separate 2-way switches (said switches).

The structure composed of the first fixed contact 158 and the variable position contacts M1, M3 and M4, or the second fixed contact 158' and the variable position contacts M1, M2 and M3, may make a 3-way switch (said diverter), while the structure composed of the fixed contacts 158 and 158' and the variable position contacts M1, M2, M3 and M4 may make a 4-way switch (said inverter).

Therefore, the presence of all the control circuits 138, 138A and 138B (or 138'), all the movable contacts M1, . . . , M4 and all the fixed contacts 158 and 158' allows the realization of a switching structure that has a variable configuration.

The second control circuit 138' allows the electrical separation of said switching structure, for example, from an external electrical system IE.

The first connection plane x1 may be disposed at a first distance d1 from the support body 100, according to a first direction v1. The second connection plane x2 may be disposed at a second distance d2 from the support body 100, according to a second direction v2 opposite to said direction v1.

At least one first control conductive terminal 110 and at least one second control conductive terminal 110' may be disposed on or exiting from a first side 301 of the support body. The plurality of signal conductive terminals T1, T2, T3, T4 may be disposed on, or exiting from, a second side 302.

In particular, the first side 301 and the second side 302 may be opposite to each other.

The at least one first control conductive terminal 110 and the at least one second control conductive terminal 110', in a currently preferred embodiment, are two terminals for each control circuit 138, 138', so that each control circuit 138, 138' may be suitably powered. For example, a positive voltage may be supplied to one control conductive terminal 110 of the first control circuit 138, and the other control conductive terminal 110 of the first control circuit 138 may be grounded, or a current may be applied in the appropriate direction when one wishes to power such first control circuit 138 to change the position of the respective controlled movable contact.

Figure 2A:
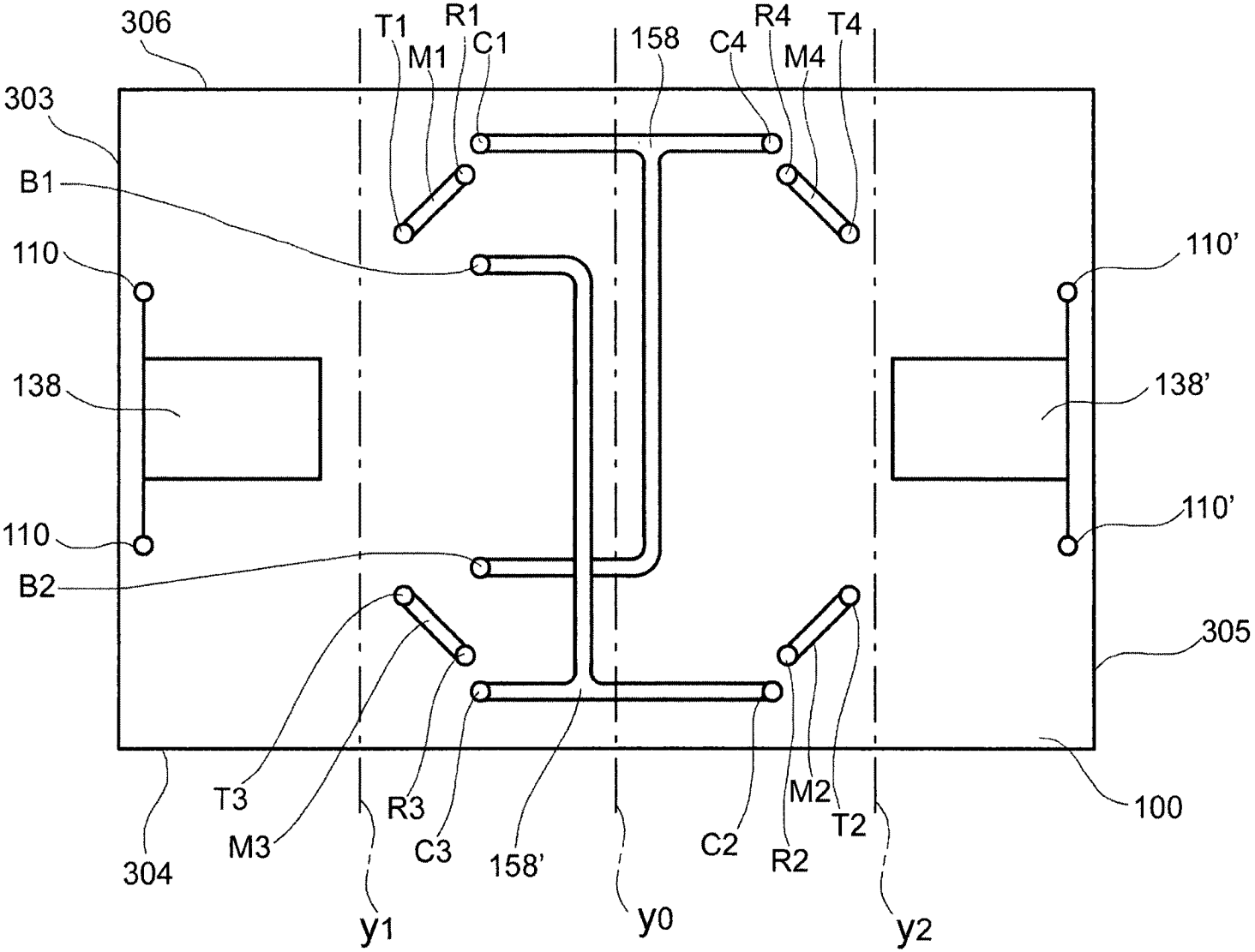
FIG. 2A illustrates an inner view of an embodiment of the integrated electromechanical device.

Still referring to FIG. 2A, the first fixed contact 158 and the second fixed contact 158' may be disposed substantially in a first region of the support body 100 comprised between two parallel planes Y1, Y2.

The first control circuit 138 may be disposed substantially in a second region of the support body 100, which is external to the first region comprised between the two parallel planes Y1, Y2.

The second control circuit 138' may be substantially disposed in a third region of the support body 100, which is external to the first region comprised between two parallel planes Y1, Y2. The third region may differ from the second region wherein the first control circuit 138 is disposed.

The second and third regions may be disposed symmetrically with respect to a symmetry axis Y0.

The first fixed contact 158 and the second fixed contact 158' may be geometrically identical.

The first fixed contact 158 and/or the second fixed contact 158' may be linear-shaped or L-shaped or T-shaped or C-shaped. In the example shown in FIGS. 2 and 3, the first fixed contact 158 and the second fixed contact 158' is T-shaped.

The at least one first control conductive terminal 110 and/or the at least one second control conductive terminal 110' may be arranged to be connected directly to a first circuit board 201. At least one signal conductive terminal of said plurality of signal conductive terminals T1, T2, T3, T4 may be arranged to be connected to a second circuit board 202 or to a respective connector or cable.

Or, the at least one first control conductive terminal 110 and/or the at least one second control conductive terminal 110' may be arranged to be connected to a first area a1 of a flexible circuit board 203 and at least one signal conductive terminal of said plurality of signal conductive terminals T1, T2, T3, T4 may be arranged to be connected to a second area a2 of the same flexible circuit board 203.

Flexible circuit boards become very useful in the case of circuit boards with complex geometries that normal circuit boards could not satisfy. Flexible circuit boards may, for example, be made of graphene.

For example, the at least one first control conductive terminal 110 and/or the at least one second control conductive terminal 110' and the signal conductive terminals of said plurality of signal conductive terminals T1, T2, T3, T4 may be connected to the circuit boards by soldering.

Moreover, as may be seen in FIG. 1, the at least one first control conductive terminal 110, the at least one second control conductive terminal 110' and the plurality of signal conductive terminals T1, T2, T3, T4 may be, by way of example, substantially linear-shaped pins, of which one end thereof fits directly into the main body 100 and the other end, intended to be soldered, may be linear or bent substantially by about 90 degrees with respect to the direction of exit from the main body 100 or may be soldered directly to respective connectors or cables of appropriate dimensions.

Also, by way of non-limiting example, the at least one first control conductive terminal 110, the at least one second control conductive terminal 110' and the plurality of signal conductive terminals T1, T2, T3, T4 may have one end intended to be soldered in a circular shape, and may be connected to the first circuit board 201 or the second circuit board 202 by means of conductive areas 210 comprised in the circuit boards 201, 202. Or, the at least one first control conductive terminal 110, the at least one second control conductive terminal 110' and the plurality of signal conductive terminals T1, T2, T3, T4, may have a linear end intended to be soldered, which is connected to a first circuit board 201 or a second circuit board 202, by means of the conductive areas 212 at the center of which a hole for the insertion of the linear end is provided. The conductive areas 212 being comprised in the first circuit board 201 or in the second circuit board 202.

Obviously, combinations of different shapes of the at least one first control conductive terminal 110, the at least one second control conductive terminal 110' and the plurality of signal conductive terminals T1, T2, T3, T4 are also possible. For example, the at least one first control conductive terminal 110 and the at least one second control conductive terminal 110' being linear-shaped pins and the plurality of signal conductive terminals T1, T2, T3, T4 being circular-shaped pins.

The support body 100 may include at least one protuberance 350 intended to be used as a centering element to align said at least one circuit board 201, 202 with said electromechanical device 1. Or, the protuberance 350 is intended to fix a minimum distance d between both said support body 100 and at least one circuit board 201, 202.

Each control circuit 138, . . . , 138' may include a coil.

The transition from the conduction condition to the isolation condition may occur by attracting or repelling the respective variable position contacts by means of a coil that may be supplied with a reference potential.

Figure 2B:
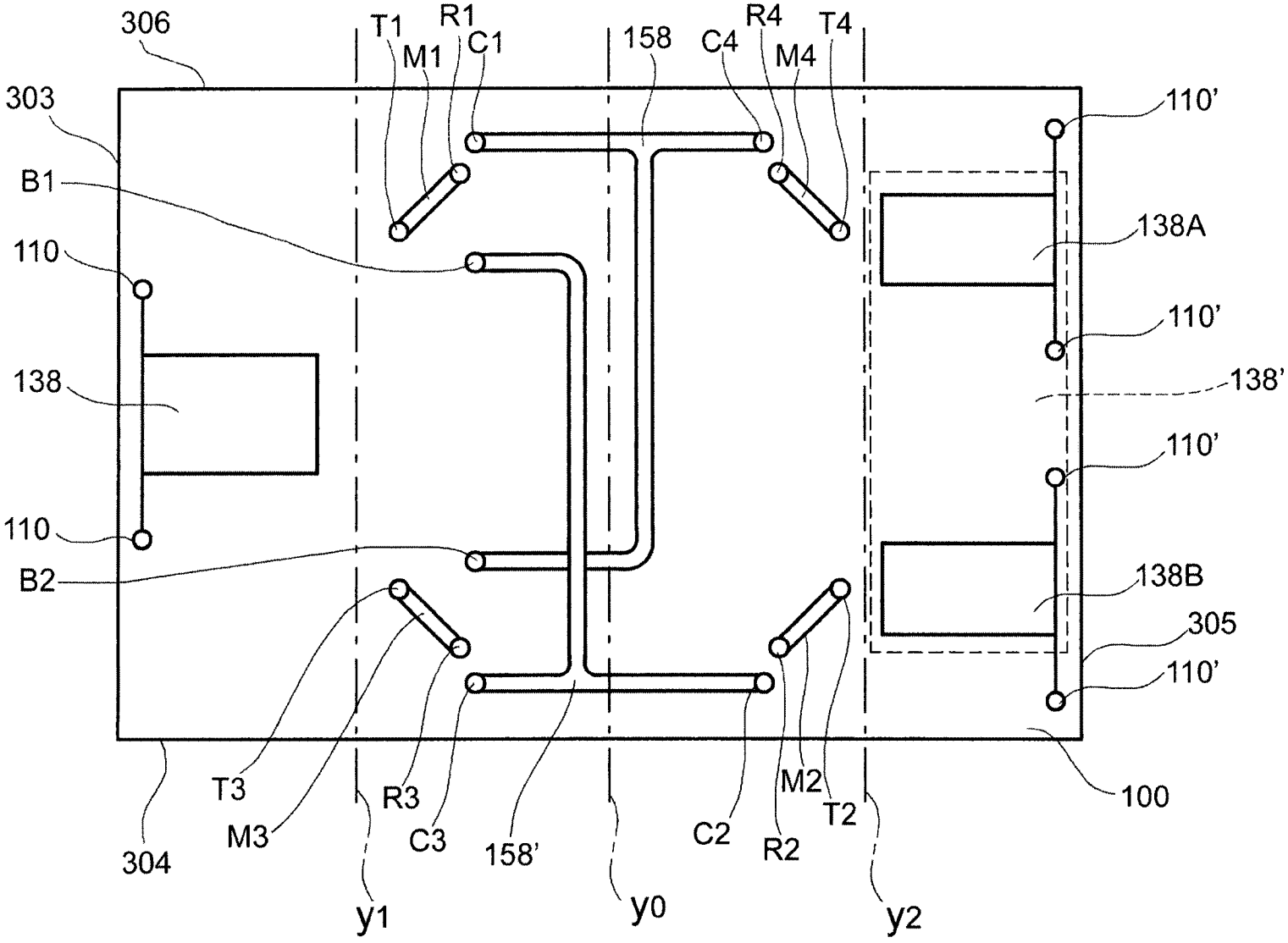
FIG. 2B illustrates an inner view of a further embodiment of the integrated electromechanical device.

As shown in detail in FIGS. 2A and 2B, the fixed contacts 158 and 158' may include a plurality of reinforcing contacts C1, C2 and the variable position contacts M1, M2 may also include a plurality of reinforcing contacts R1, R2 so that the contact area between a variable position contact and the respective fixed contact is such as to ensure a predetermined value of electrical current through such contacts.

The integrated electromechanical device 1 may further comprise at least one first support S1 and/or a second support S2 arranged to be used as the positioning base for the at least one first control conductive terminal 110 and/or said plurality of signal conductive terminals T1, T2, T3, T4 or for the fixed contacts 158, 158'.

Or, said first support S1 and/or second support S2 is arranged to be used as the closing cover of said integrated electromechanical device 1.

Furthermore, the first support S1 and/or the second support S2 comprised in the support body 100 may be circuit boards including at least an electronic interface device or an electronic protection component for the control circuits 138, . . . , 138', such as a diode.

The support body 100 may include chamfers C and/or may be tapered on one or more corners of said support body 100 and/or may include one or more cavities 320 disposed on any side 301, . . . , 306 of said support body 100. The cavities are used to contain or facilitate the assembly of the fastener or fasteners, such as screws or rivets, intended to secure the object comprising the electromechanical device and the circuit board(s) thereof to an external container, or said cavities may simply be used to reduce the weight of said electromechanical device.

As shown in detail in FIG. 4, the support body 100 may have such a shape whereby the plurality of signal conductive terminals T1, T2, T3, T4 may be disposed on, or exit from, a surface 302 or another surface 302' which is parallel to the surface 302, at a distance A.

Moreover, the support body 100 may be of such a shape that at least one first control conductive terminal 110 and/or at least one second control conductive terminal 110' may be disposed on, or exiting from, a surface 301 or another surface 301', parallel to the surface 301, at a distance B.

Appropriately, since the aforementioned electromechanical device includes at least one variable position contact and a respective variable position contact control circuit, it is possible to create electronic products also composed of several circuit boards, even without the aid of dedicated internal connectors, to connect, for example, generic electronic signals or power supplies.

Figure 2C:
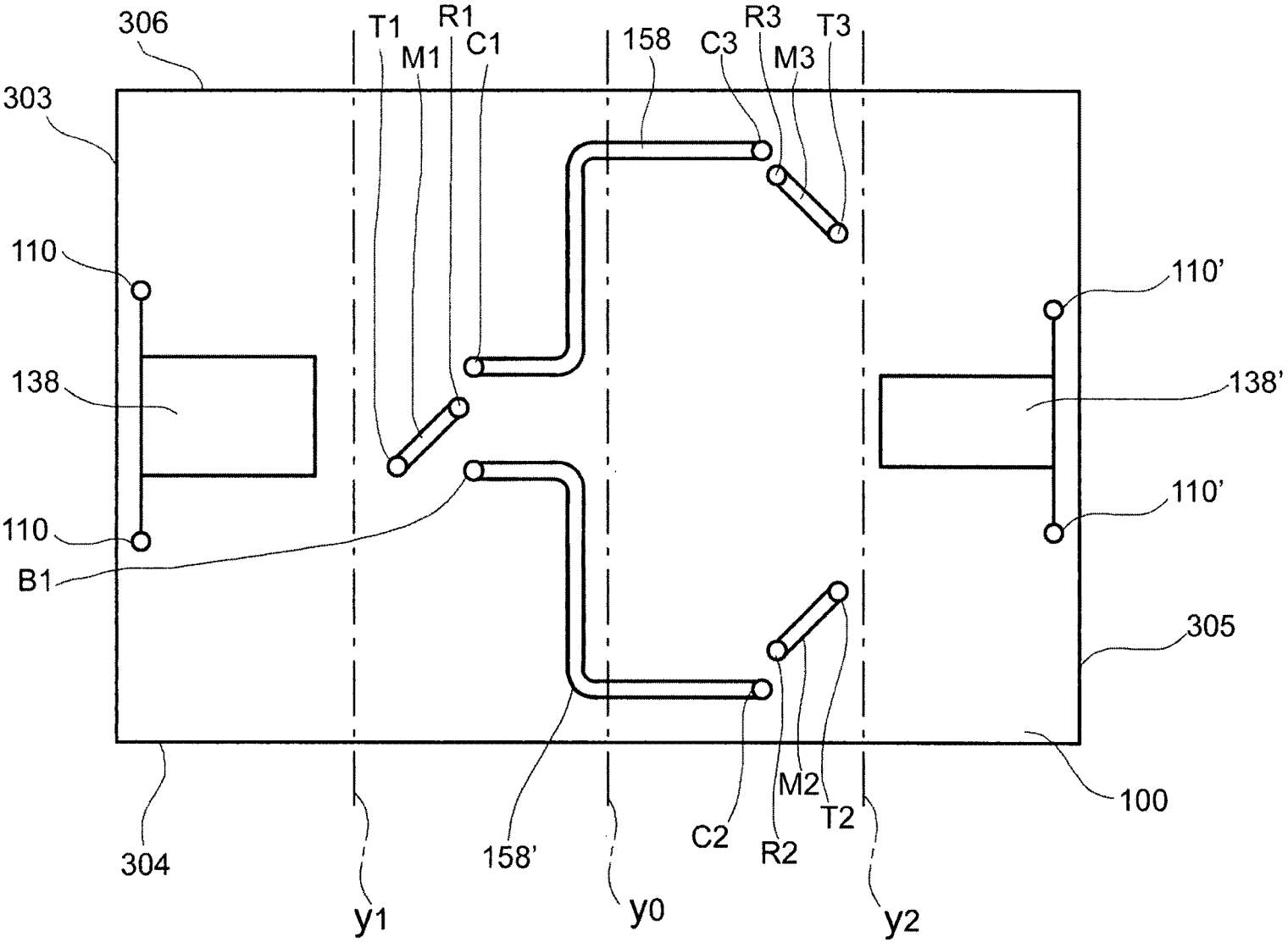
FIG. 2C illustrates an inner view of a still further embodiment of the integrated electromechanical device.

In a still further embodiment shown in FIG. 2C, the integrated electromechanical device 1 comprises a support body 100 which includes a plurality of sides 301, . . . , 306.

The integrated electromechanical device 1 further comprises a first fixed contact 158 and a second fixed contact 158', a first variable position contact M1, a second variable position contact M2, a third variable position contact M3, in this embodiment the nomenclature of the contacts M1, M2, M3 being different from the nomenclature of contacts of the previous embodiments and/or variants.

A first control circuit 138 is arranged to control the first variable position contact M1, and a second control circuit 138' is arranged to control the second variable position contact M2 and the third variable position contact M3, and a plurality of signal conductive terminals T1, T2, T3.

The plurality of signal conductive terminals T1, T2, T3 comprise a first signal conductive terminal T1 connected to the first variable position contact M1, a second signal conductive terminal T2 connected to the second variable position contact M2 and a third signal conductive terminal T3 connected to the third variable position contact M3.

At least one first control conductive terminal 110 is connected to the first control circuit 138 and at least one second control conductive terminal 110' is connected to the second control circuit 138'.

The first signal conductive terminal T1, in a first predetermined condition, is electrically connected to the second fixed contact 158' and, in a second predetermined condition, is connected to the first fixed contact 158 by means of the first variable position contact M1. The transition from the first to the second condition and vice versa is controlled by the first control circuit 138.

The second signal conductive terminal T2 and the second fixed contact 158', in a predetermined conduction condition, are electrically connected to each other via the second variable position contact M2 and, in a predetermined isolation condition, are not electrically connected to each other. The transition from the conduction condition to the isolation condition and vice versa is controlled by the second control circuit 138'.

The third signal conductive terminal T3 and the first fixed contact 158, in a predetermined conduction condition, are electrically connected to each other via said third variable position contact M3 and, in a predetermined isolation condition, are not electrically connected to each other. The transition from the conduction condition to the isolation condition and vice versa is controlled by the second control circuit 138'.

The first variable position contact M1, the second variable position contact M2, the third variable position contact M3, the first fixed contact 158 and the second fixed contact 158' are made so that, in any positioning configuration of the first variable position contact M1, of the second variable position contact M2 and of the third variable position contact M3, the first fixed contact 158 and the second fixed contact 158' are always in a condition of electrical isolation therebetween.

The at least one first control conductive terminal 110, the at least one second control conductive terminal 110' and each signal conductive terminal of said plurality of signal conductive terminals T1, T2, T3 each comprise a respective connection end region 100A, 112A distal with respect to the support body 100.

The connection end regions 100A of the at least one first control conductive terminal 110 and of the at least one second control conductive terminal 110' are disposed on a first connection plane x1 and the connection end regions 112A of each signal conductive terminal of the plurality of signal conductive terminals T1, T2, T3 are disposed on a second connection plane x2, different and parallel to the first connection plane x1.

The second control circuit 138' may comprise at least one first control sub-circuit arranged to control the second variable position contact M2 and a second control sub-circuit arranged to control the third variable position contact M3.

The second variable position contact M2 may thus be controlled independently of the third variable position contact M3.

The presence of the two control sub-circuits, which separately control the variable position contacts M2 and M3, make it possible to make two totally separate 2-way switches (called switches).

The first connection plane x1 may be disposed at a first distance d1 from the support body 100, according to a first direction v1, and the second connection plane x2 may be disposed at a distance d2 from the support body 100, according to a second direction v2 opposite to the direction v1.

The at least one first control conductive terminal 110 and the at least one second control conductive terminal 110' may be disposed on, or exiting from, a first side 301 of the support body with said plurality of signal conductive terminals T1, T2, T3, disposed on, or exiting from, a second side 302. The first side 301 and the second side 302 may be opposite to each other.

The first fixed contact 158 and the second fixed contact 158' may be substantially disposed in a first region of the support body 100 comprised between two parallel planes Y1, Y2.

The first control circuit 138 may be disposed in a second region of the support body 100, which is external to the first region comprised between the two parallel planes Y1, Y2. The second control circuit 138' may be disposed substantially in a third region of the support body 100, which is external to the first region comprised between the two parallel planes Y1, Y2 and is different from the second region wherein the first control circuit 138 is disposed. The second and third regions may be disposed symmetrically with respect to a symmetry axis Y0.

The first fixed contact 158 and the second fixed contact 158' may respectively be linear-shaped or L-shaped or T-shaped or C-shaped.

The at least one first control conductive terminal 110 and/or the at least one second conductive terminal 110' may be arranged to be connected directly to a first circuit board 201 and at least one signal conductive terminal of said plurality of signal conductive terminals T, T2, T3 may be arranged to be connected to a second circuit board 202 or to a respective connector or cable.

The at least one first control conductive terminal 110 and/or the at least one second control conductive terminal 110' may be arranged to be connected to a first area a1 of a flexible circuit board 203, and at least one signal conductive terminal of said plurality of signal conductive terminals T1, T2, T3 may be arranged to be connected to a second area a2 of the same flexible circuit board 203.

The support body 100 may include at least one protuberance 350 intended to be used as a centering element to align said at least one circuit board 201, 202 with the electromechanical device 1 or may be intended to fix a minimum distance d between the support body 100 and at least one circuit board 201, 202.

Each control circuit 138, . . . , 138' may include a coil.

The integrated electromechanical device 1 may further comprise at least a first support S1 and/or a second support S2 arranged to be used as the positioning base for the at least one first control conductive terminal 110 and/or for the plurality of signal conductive terminals T1, T2, T3 or for the fixed contacts 158, 158'.

Or, the first support S1 and/or second support S2 may be arranged to be used as the closing cover of the integrated electromechanical device 1.

Obviously, all the detailed aspects described for the previous embodiments and not repeated here are intended to apply to this further embodiment as long as they are not in opposition thereto.

Various aspects and embodiments of an integrated electromechanical device according to the invention have been described. It is understood that each embodiment may be combined with any other embodiment.

Naturally, without altering the principle of the invention, the embodiments and the details of construction may vary widely with respect to those described and illustrated purely by way of non-limiting example, without thereby departing from the scope of the invention as defined in the accompanying claims.

The invention claimed is:

1. An integrated electromechanical device comprising:

a support body including a plurality of sides; and a first fixed contact and a second fixed contact, a first variable position contact, a second variable position contact, a third variable position contact, a fourth variable position contact, a first control circuit arranged to control the first variable position contact and the third variable position contact, and a second control circuit arranged to control the second variable position contact and the fourth variable position contact, and a plurality of signal conductive terminals;

wherein the plurality of signal conductive terminals comprise a first signal conductive terminal connected to the first variable position contact, a second signal conductive terminal connected to the second variable position contact, a third signal conductive terminal connected to the third variable position contact, and a fourth signal conductive terminal connected to the fourth variable position contact;

wherein at least one first control conductive terminal is connected to the first control circuit and at least one second control conductive terminal is connected to the second control circuit;

wherein the first signal conductive terminal, in a first predetermined condition, is electrically connected to the second fixed contact and, in a second predetermined condition, is connected to the first fixed contact through the first variable position contact, wherein a transition from the first condition to the second condition, and vice versa, is controlled by the first control circuit;

wherein the third signal conductive terminal, in a first predetermined condition, is electrically connected to the first fixed contact and, in a second predetermined condition, is connected to the second fixed contact through the third variable position contact wherein a transition from the first condition to the second condition, and vice versa, is controlled by the first control circuit;

wherein the second signal conductive terminal and the second fixed contact, in a predetermined conduction condition, are electrically connected to each other via the second variable position contact and, in a predetermined isolation condition, are not electrically connected to each other wherein a transition from the conduction condition to the isolation condition, and vice versa, is controlled by the second control circuit;

wherein the fourth signal conductive terminal and the first fixed contact, in a predetermined conduction condition, are electrically connected to each other through the fourth variable position contact and, in a predetermined isolation condition, are not connected electrically to each other wherein a transition from the conduction condition to the isolation condition, and vice versa, is controlled by the second control circuit;

wherein the first variable position contact the second variable position contact, the third variable position contact, the fourth variable position contact, the first fixed contact, and the second fixed contact are made so that, in any positioning configuration of the first variable position contact, of the second variable position contact, of the third variable position contact, and of the fourth variable position contact, the first fixed contact and the second fixed contact are always in an electrical isolation condition between them;

wherein the at least one first control conductive terminal, the at least one second control conductive terminal, and each signal conductive terminal of the plurality of signal conductive terminals, each comprise a respective connection end region that is distal with respect to the support body;

wherein the connection end regions of the at least one first control conductive terminal and of the at least one second control conductive terminal are disposed on a first connection plane and the connection end regions of each signal conductive terminal of the plurality of signal conductive terminals are disposed on a second connection plane that is different and parallel to the first connection plane.

2. The integrated electromechanical device according to claim 1, wherein the first control circuit comprises at least a first control sub-circuit arranged to control the first variable position contact and a second control sub-circuit arranged to control the third variable position contact, wherein the first variable position contact is controlled independently from the third variable position contact.

3. The integrated electromechanical device according to claim 1, wherein the second control circuit comprises at least a first control sub-circuit arranged to control the second variable position contact and a second control sub-circuit arranged to control the fourth variable position contact, wherein the second variable position contact are controlled independently from the fourth variable position contact.

4. The integrated electromechanical device according to claim 1, wherein the first connection plane is disposed at a first distance from the support body, according to a first direction, and the second connection plane is disposed at a second distance from the support body, according to a second direction opposite to the first direction.

5. The integrated electromechanical device according to claim 1, wherein the at least one first control conductive terminal and the at least one second control conductive terminal are disposed on, or exiting from, a first side of the support body, and wherein the plurality of signal conductive terminals are disposed on, or exiting from, a second side, the first side (301) and the second side (302) being opposite to each other.

6. The integrated electromechanical device according to claim 1, wherein the first fixed contact and the second fixed contact are disposed in a first region of the support body comprised between two parallel planes.

7. The integrated electromechanical device according to claim 6, wherein the first control circuit is disposed in a second region of the support body that is external to the first region comprised between the two parallel planes, the second control circuit being disposed in a third region of the support body that is external to the first region comprised between the two parallel planes and that is different from the second region wherein the first control circuit is disposed, and wherein the second region and the third region are disposed symmetrically to each other with respect to a symmetry axis.

8. The integrated electromechanical device according to claim 1, wherein the first fixed contact and the second fixed contact are geometrically equal.

9. The integrated electromechanical device according to claim 1, wherein the first fixed contact and/or the second fixed contact are linear-shaped or L-shaped or T-shaped or C-shaped.

10. The integrated electromechanical device according to claim 1, wherein the at least one first control conductive terminal and/or the at least one second control conductive terminal is/are arranged to be connected directly to a first circuit board, and wherein at least one signal conductive terminal of the plurality of signal conductive terminals is arranged to be connected to a second circuit board or to a respective connector or cable.

11. The integrated electromechanical device according to claim 1, wherein the at least one first control conductive terminal and/or the at least one second control conductive terminal is/are arranged to be connected to a first area of a flexible circuit board, and wherein at least one signal conductive terminal of the plurality of signal conductive terminals is arranged to be connected to a second area of the same flexible circuit board.

12. The integrated electromechanical device according to claim 1, wherein the support body includes at least one protuberance configured to be used as a centering element for aligning the at least one circuit board with the integrated electromechanical device or configured to fix a minimum distance between the support body and at least one circuit board.

13. The integrated electromechanical device according to claim 1, wherein each control circuit includes a coil.

14. The integrated electromechanical device according to claim 1, further comprising at least a first support and/or a second support arranged to be used as a positioning base for the at least one first control conductive terminal and/or the plurality of signal conductive terminals or for the fixed contacts, or the first support and/or second support being arranged to be used as the closing cover of the integrated electromechanical device.

15. An integrated electromechanical device comprising:

a support body including a plurality of sides; and a first fixed contact and a second fixed contact, a first variable position contact, a second variable position contact, a third variable position contact, a first control circuit arranged to control the first variable position contact, and a second control circuit arranged to control the second variable position contact and the third variable position contact, and a plurality of signal conductive terminals;

wherein the plurality of signal conductive terminals comprise a first signal conductive terminal connected to the first variable position contact, a second signal conductive terminal connected to the second variable position contact, and a third signal conductive terminal connected to the third variable position contact;

wherein at least one first control conductive terminal is connected to the first control circuit and at least one second control conductive terminal is connected to the second control circuit;

wherein the first signal conductive terminal, in a first predetermined condition, is electrically connected to the second fixed contact and, in a second predetermined condition, is connected to the first fixed contact through the first variable position contact, wherein a transition from the first condition to the second condition, and vice versa, the controlled by the first control circuit wherein the second signal conductive terminal and the second fixed contact in a predetermined conduction condition, are electrically connected to each other via the second variable position contact and, in a predetermined isolation condition, are not electrically connected to each other, wherein a transition from the conduction condition to the isolation condition, and vice versa, a controlled by the second control circuit;

the third signal conductive terminal and the first fixed contact, in a predetermined conduction condition, are electrically connected to each other through the third variable position contact and, in a predetermined isolation condition, they are not connected electrically to each other, wherein a transition from the conduction condition to the isolation condition, and vice versa, are controlled by the second control circuit;

wherein the first variable position contact, the second variable position contact, the third variable position contact, the first fixed contact, and the second fixed contact are made so that, in any positioning configuration of the first variable position contact, of the second variable position contact, and of the third variable position contact, the first fixed contact and the second fixed contact are always in an electrical isolation condition between them;

wherein the at least one first control conductive terminal, the at least one second control conductive terminal, and each signal conductive terminal of the plurality of signal conductive terminals, each comprise a respective connection end region that is distal with respect to the support body; and wherein the connection end regions of the at least one first control conductive terminal and of the at least one second control conductive terminal are disposed on a first connection plane, and the connection end regions of each signal conductive terminal of the plurality of signal conductive terminals are disposed on a second connection plane, different and parallel to the first connection plane.

* * * * *